US011319507B2

(12) United States Patent
Suzuki et al.

(10) Patent No.: US 11,319,507 B2
(45) Date of Patent: May 3, 2022

(54) CLEANING LIQUID FOR AQUEOUS INK COMPRISING AN ACETYLENE GLYCOL-BASED SURFACTANT

(71) Applicant: KAO CORPORATION, Tokyo (JP)

(72) Inventors: Takayuki Suzuki, Barcelona (ES); Yasufumi Ueda, Nakayama (JP)

(73) Assignee: KAO CORPORATION, Tokyo (JP)

( * ) Notice: Subject to any disclaimer, the term of this patent is extended or adjusted under 35 U.S.C. 154(b) by 311 days.

(21) Appl. No.: 16/473,494

(22) PCT Filed: Dec. 26, 2017

(86) PCT No.: PCT/JP2017/046758
§ 371 (c)(1),
(2) Date: Jun. 25, 2019

(87) PCT Pub. No.: WO2018/124120
PCT Pub. Date: Jul. 5, 2018

(65) Prior Publication Data

US 2021/0277331 A1 Sep. 9, 2021

(30) Foreign Application Priority Data

Dec. 28, 2016 (JP) ..... JP2016-255708

(51) Int. Cl.

| | |
|---|---|
| ***C11D 1/72*** | (2006.01) |
| ***B41J 2/165*** | (2006.01) |
| ***C11D 3/20*** | (2006.01) |
| ***C11D 3/43*** | (2006.01) |
| ***C11D 11/00*** | (2006.01) |
| ***C11D 17/00*** | (2006.01) |

(52) U.S. Cl.
CPC ..... *C11D 1/72* (2013.01); *B41J 2/16552* (2013.01); *C11D 3/2055* (2013.01); *C11D 3/43* (2013.01); *C11D 11/0041* (2013.01); *C11D 17/0008* (2013.01)

(58) Field of Classification Search
CPC ..... C11D 1/72; C11D 1/825; C11D 3/2041; C11D 3/2068; C11D 3/3707; C11D 7/263; C11D 7/5004; C11D 7/5022; C11D 7/5077; C11D 11/0023
See application file for complete search history.

(56) References Cited

U.S. PATENT DOCUMENTS

| | | | | |
|---|---|---|---|---|
| 6,723,784 | B2 * | 4/2004 | Ito | B41M 7/0027 106/31.57 |
| 6,921,433 | B2 * | 7/2005 | Kuribayashi | C09D 11/32 106/499 |
| 2002/0147300 | A1 * | 10/2002 | Matsumoto | B41N 3/08 528/422 |
| 2004/0025723 | A1 * | 2/2004 | Hanneman, Jr. | B41N 3/08 101/147 |
| 2005/0018023 | A1 | 1/2005 | Momose et al. | |
| 2005/0049167 | A1 | 3/2005 | Noereneerg et al. | |
| 2007/0132807 | A1 | 6/2007 | Ota | |
| 2011/0061678 | A1 * | 3/2011 | Koshiyama | C11D 3/43 134/1 |
| 2011/0224117 | A1 | 9/2011 | Mitsuishi et al. | |
| 2013/0257975 | A1 | 10/2013 | Aoyama | |
| 2017/0175030 | A1 * | 6/2017 | Jibiki | C10M 135/26 |
| 2018/0171255 | A1 * | 6/2018 | Jibiki | C10M 105/24 |

FOREIGN PATENT DOCUMENTS

| | | | |
|---|---|---|---|
| CN | 1620495 | A | 5/2005 |
| CN | 102171324 | A | 8/2011 |
| JP | 62-135598 | A | 6/1987 |
| JP | H05-51599 | A | 3/1993 |
| JP | 5-171092 | A | 7/1993 |
| JP | 2007-119658 | A | 5/2007 |
| JP | 2007-169314 | A | 7/2007 |
| JP | 2013-212624 | A | 10/2013 |
| JP | 2013-241552 | A | 12/2013 |
| JP | 2014-079932 | A | 5/2014 |

OTHER PUBLICATIONS

International Search Report for PCT/JP2017/046758 (PCT/ISA/210) dated Mar. 13, 2018, with English translation.
Chinese Office Action and Search Report dated Jun. 22, 2020 for Application No. 201780080087.X.
Extended European Search Report dated Jun. 29, 2020 for Application No. 17888486.2.

* cited by examiner

*Primary Examiner* — Charles I Boyer
(74) *Attorney, Agent, or Firm* — Birch, Stewart, Kolasch & Birch, LLP

(57) ABSTRACT

The present invention relates to a cleaning liquid for a water-based ink that contains a pigment and a water-insoluble polymer, said cleaning liquid containing (A) an acetylene glycol having an average molar number of addition of EO of 0 to 2 mol, (B) at least one compound selected from the group consisting of an acetylene glycol having an average molar number of addition of EO of not less than 4 mol and a polyethylene glycol alkyl ether containing an alkyl group having not less than 8 carbon atoms, (C) a water-soluble organic solvent and water, in which the water-soluble organic solvent (C) contains at least one water-soluble organic solvent having a boiling point of not lower than 90° C.; a boiling point of the water-soluble organic solvent (C) is not higher than 250° C. in terms of a weighted mean value thereof; and a content of the water-soluble organic solvent (C) in the cleaning liquid is not more than 20% by mass; a process for producing the cleaning liquid; and a method of cleaning a water-based ink using the cleaning liquid.

20 Claims, No Drawings

CLEANING LIQUID FOR AQUEOUS INK COMPRISING AN ACETYLENE GLYCOL-BASED SURFACTANT

FIELD OF THE INVENTION

The present invention relates to a cleaning liquid for a water-based ink.

BACKGROUND OF THE INVENTION

In ink-jet printing methods, droplets of ink are directly projected from very fine nozzles onto a printing medium using an ink-jet printer, and allowed to adhere to the printing medium to obtain printed materials on which characters or images are printed. In the sites actually using the ink-jet printer, if the nozzles of the ink-jet printer suffer from ejection defects, etc., an end face or an ink ejection port of the respective nozzles is wiped with a nonwoven fabric or the like impregnated with a cleaning liquid, to remove a surplus amount of the ink attached thereto. In addition, in the case of using different kinds of inks, it is necessary to clean up an ink path within the ink-jet printer using a cleaning liquid before or after changing the ink to be used from one to another. Furthermore, in the case where a print head of the ink-jet printer remains in a non-used condition for a long period of time, it is usual that after removing the ink from the print head, the cleaning liquid is filled in the print head, and the print head filled with the cleaning liquid is closed by capping for storage.

Also, in a gravure printing method, an ink is transferred to a printing medium using a gravure printing plate cylinder on which recessed cells for receiving the ink are formed. The depth of each of the cells as well as the distance between the respective cells (number of lines) can be adequately determined to well control a quality of characters or images printed by the gravure printing method. In this case, if the gravure printing plate cylinder is stained or fouled by the ink, it is required that the cylinder is dismounted from the gravure printer and then cleaned with a brush, etc., while dissolving the ink deposited thereon using a cleaning liquid. In consequence, there have been conventionally proposed various cleaning liquids containing a surfactant.

For example, JP 2013-241552A (Patent Literature 1) discloses a cleaning and filling liquid for an ink-jet printing apparatus which is excellent in wettability and cleanability, etc., and is also excellent in compatibility with an ink even when using a pigment ink as the ink for printing characters or images and is also free of occurrence of ejection defects upon refilling the ink in the ink-jet printing apparatus, in which a surfactant used therein contains at least a fluorine-based surfactant and an acetylene glycol-based surfactant having an average molar number of addition of ethyleneoxide of 0 to 30.

JP 2014-79932A (Patent Literature 2) discloses a maintenance liquid that is excellent in dissolution stability and storage stability, and contains an alkyleneoxide adduct of an acetylene glycol whose main chain has not less than 12 carbon atoms, an acetylene glycol whose main chain has not less than 10 carbon atoms, and a polyoxyalkylene alkyl ether.

SUMMARY OF THE INVENTION

The present invention relates to a cleaning liquid for a water-based ink that contains a pigment and a water-insoluble polymer, said cleaning liquid containing (A) an acetylene glycol having an average molar number of addition of ethyleneoxide of not less than 0 mol and not more than 2 mol, (B) at least one compound selected from the group consisting of (b-1) an acetylene glycol having an average molar number of addition of ethyleneoxide of not less than 4 mol and (b-2) a polyethylene glycol alkyl ether containing an alkyl group having not less than 8 carbon atoms, (C) a water-soluble organic solvent and water, in which the water-soluble organic solvent (C) contains at least one water-soluble organic solvent having a boiling point of not lower than 90° C.;

a boiling point of the water-soluble organic solvent (C) is not higher than 250° C. in terms of a weighted mean value of boiling points of respective water-soluble organic solvents contained therein which are weighted by contents (% by mass) of the respective water-soluble organic solvents; and a content of the water-soluble organic solvent (C) in the cleaning liquid is not more than 20% by mass.

DETAILED DESCRIPTION OF THE INVENTION

On the other hand, in an ink-jet printer or a gravure printer, a water-based ink containing a pigment and a water-insoluble polymer has been used in order to improve dispersibility of the pigment in the ink or improve fixing properties of the ink on the resulting printed material. When the pigment and the water-insoluble polymer contained in such a water-based ink are solidified, the bonding between the pigment and the polymer or between the polymer molecules is strengthened. For this reason, there is an increasing demand for a cleaning liquid having higher cleanability for the water-based ink containing the pigment and the water-insoluble polymer. In addition, if a surfactant having high affinity to the solidified water-insoluble polymer is used in order to enhance cleanability for the pigment or the water-insoluble polymer, the surfactant tends to be deteriorated in dissolvability in the cleaning liquid. Furthermore, if the cleaning liquid remains on a member cleaned therewith such as nozzles, ink paths, a print head, a gravure printing plate cylinder, etc., there tend to occur not only ejection defects, but also deterioration in quality of the resulting printed materials. Therefore, it has been demanded to provide a cleaning liquid that hardly remains on the member to be cleaned.

The present invention relates to a cleaning liquid for a water-based ink which is excellent in cleanability for the water-based ink and dissolvability of a surfactant therein, and hardly remains on a member to be cleaned, a process for producing the cleaning liquid, and a method of cleaning a water-based ink using the cleaning liquid.

The present inventors have found that by using a cleaning liquid containing an acetylene glycol having an average molar number of addition of ethyleneoxide which falls within a specific range, another acetylene glycol having an average molar number of addition of ethyleneoxide which is larger than that of the aforementioned acetylene glycol or a polyethylene glycol alkyl ether containing an alkyl group having a specific number of carbon atoms, and a specific water-soluble organic solvent, it is possible to improve cleanability for a water-based ink and dissolvability of a surfactant in the cleaning liquid, and prevent the cleaning liquid from remaining on a member to be cleaned.

That is, the present invention relates to the following aspects [1] to [3].

[1] A cleaning liquid for a water-based ink that contains a pigment and a water-insoluble polymer, said cleaning liquid containing (A) an acetylene glycol having an average molar number of addition of ethyleneoxide of not less than 0 mol and not more than 2 mol, (B) at least one compound selected from the group consisting of (b-1) an acetylene glycol having an average molar number of addition of ethyleneoxide of not less than 4 mol and (b-2) a polyethylene glycol alkyl ether containing an alkyl group having not less than 8 carbon atoms, (C) a water-soluble organic solvent and water, in which the water-soluble organic solvent (C) contains at least one water-soluble organic solvent having a boiling point of not lower than 90° C.;

a boiling point of the water-soluble organic solvent (C) is not higher than 250° C. in terms of a weighted mean value of boiling points of respective water-soluble organic solvents contained therein which are weighted by contents (% by mass) of the respective water-soluble organic solvents; and a content of the water-soluble organic solvent (C) in the cleaning liquid is not more than 20% by mass.

[2] A method of cleaning a water-based ink including the step of allowing a water-based ink that contains a pigment and a water-insoluble polymer to come into contact with the cleaning liquid according to the above aspect [1].

[3] A process for producing a cleaning liquid for a water-based ink, including the step of compounding (A) an acetylene glycol having an average molar number of addition of ethyleneoxide of not less than 0 mol and not more than 2 mol, (B) at least one compound selected from the group consisting of (b-1) an acetylene glycol having an average molar number of addition of ethyleneoxide of not less than 4 mol and (b-2) a polyethylene glycol alkyl ether containing an alkyl group having not less than 8 carbon atoms, (C) a water-soluble organic solvent and water, in which the water-soluble organic solvent (C) contains at least one water-soluble organic solvent having a boiling point of not lower than 90° C.;

a boiling point of the water-soluble organic solvent (C) is not higher than 250° C. in terms of a weighted mean value of boiling points of respective water-soluble organic solvents contained therein which are weighted by contents (% by mass) of the respective water-soluble organic solvents; and a content of the water-soluble organic solvent (C) in the cleaning liquid is not more than 20% by mass.

In accordance with the present invention, it is possible to provide a cleaning liquid for a water-based ink which is excellent in cleanability for the water-based ink and dissolvability of a surfactant therein, and hardly remains on a member to be cleaned, a process for producing the cleaning liquid, and a method of cleaning a water-based ink using the cleaning liquid.

[Cleaning Liquid for Water-Based Ink]

The cleaning liquid for a water-based ink according to the present invention (hereinafter also referred to merely as a "cleaning liquid") is used for cleaning a water-based ink that contains a pigment and a water-insoluble polymer (hereinafter also referred to merely as a "polymer"). The cleaning liquid contains (A) an acetylene glycol having an average molar number of addition of ethyleneoxide (hereinafter also referred to merely as "EO") of not less than 0 mol and not more than 2 mol (hereinafter also referred to merely as an "acetylene glycol (A)" or a "component (A)"), (B) at least one compound selected from the group consisting of (b-1) an acetylene glycol having an average molar number of addition of EO of not less than 4 mol (hereinafter also referred to merely as an "acetylene glycol (b-1)") and (b-2) a polyethylene glycol alkyl ether containing an alkyl group having not less than 8 carbon atoms (hereinafter also referred to merely as a "polyethylene glycol alkyl ether (b-2)") (hereinafter also referred to merely as a "compound (B)" or a "component (B)"), (C) a water-soluble organic solvent (hereinafter also referred to merely as a "component (C)") and water, in which the water-soluble organic solvent (C) contains at least one water-soluble organic solvent having a boiling point of not lower than 90° C.; a boiling point of the water-soluble organic solvent (C) is not higher than 250° C. in terms of a weighted mean value of boiling points of respective water-soluble organic solvents contained therein which are weighted by contents (% by mass) of the respective water-soluble organic solvents; and a content of the water-soluble organic solvent (C) in the cleaning liquid is not more than 20% by mass.

Meanwhile, the term "water-based" as used herein means that water has a largest content among components of a dispersing medium contained in the ink, and the "water-based ink" is hereinafter also referred to merely as an "ink". In addition, the cleaning liquid containing the acetylene glycol (A) having an average molar number of addition of EO of not less than 0 mol and not more than 2 mol and the at least one compound (B) selected from the group consisting of the acetylene glycol (b-1) having an average molar number of addition of EO of not less than 4 mol and the polyethylene glycol alkyl ether (b-2) containing an alkyl group having not less than 8 carbon atoms may be in the form of a cleaning liquid prepared by compounding the acetylene glycol (A) and the compound (B).

Furthermore, the acetylene glycol as used in the present invention means a so-called acetylene glycol-based surfactant in a broad sense, more specifically, a nonionic surfactant having such a structure in which an acetylene group is located at a center thereof, and not only a hydroxy group but also a hydrocarbon group may be bonded thereto. The number of carbon atoms in the hydrocarbon group is preferably not less than 1 and not more than 6.

The cleaning liquid of the present invention is capable of exhibiting such an effect that the cleaning liquid is excellent in cleanability for ink and dissolvability of a surfactant therein, and hardly remains on a member to be cleaned. The reason why these advantageous effects can be attained by the present invention is considered as follows though it is not clearly determined.

That is, the acetylene glycol (A) exhibits hydrophobic properties and has high affinity to the water-insoluble polymer because of a small average molar number of addition of EO thereof. For this reason, the acetylene glycol (A) is excellent in penetrability into the polymer, and serves for weakening a bonding force between the pigment and the polymer or between the polymer molecules to thereby improve cleanability of the cleaning liquid for the ink containing the pigment and the water-insoluble polymer. On the contrary, the acetylene glycol (A) is deteriorated in dissolvability in an aqueous solvent. On the other hand, the acetylene glycol (b-1) used as the compound (B) has a larger average molar number of addition EO than that of the acetylene glycol (A), and the polyethylene glycol alkyl ether (b-2) also used as the compound (B) contains an alkyl group having not less than 8 carbon atoms and has a polyethylene glycol chain, so that the compound (B) has high affinity to the acetylene glycol (A) and is capable of improving dissolvability of the acetylene glycol (A) in an aqueous solvent. Furthermore, by controlling the boiling point of the water-soluble solvent (C) as well as the content of the water-soluble solvent (C) in the cleaning liquid to respective specific ranges, the water-soluble solvent (C) tends to hardly remain on a member to be cleaned. Owing to the synergistic effect of the aforementioned characteristics, it is considered that the cleaning liquid of the present invention is capable of satisfying both of high cleanability for ink and good dissolvability of a surfactant therein, and further exhibiting such an effect of preventing the cleaning liquid from remaining on a member to be cleaned.

<Acetylene Glycol (A)>

The cleaning liquid of the present invention contains the acetylene glycol (A) having an average molar number of addition of EO of not less than 0 mol and not more than 2 mol as a surfactant from the viewpoint of improving cleanability for ink.

The average molar number of addition of EO of the acetylene glycol (A) is not less than 0 mol, and is also not more than 2 mol, preferably not more than 1.5 mol, more preferably not more than 1 mol and even more preferably 0, from the viewpoint of improving cleanability for ink.

The acetylene glycol (A) is preferably at least one compound selected from the group consisting of 2,4,7,9-tetramethyl-5-decyne-4,7-diol, 3,6-dimethyl-4-octyne-3,6-diol, 2,5-dimethyl-3-hexyne-2,5-diol, 2,5,8,11-tetramethyl-6-dodecyne-5,8-diol, 3,5-dimethyl-1-hexyne-3-ol and EO adducts of these compounds, more preferably at least one compound selected from the group consisting of 2,4,7,9-tetramethyl-5-decyne-4,7-diol, 3,6-dimethyl-4-octyne-3,6-diol, 2,5-dimethyl-3-hexyne-2,5-diol and EO adducts of these compounds, and even more preferably at least one compound selected from the group consisting of 2,4,7,9-tetramethyl-5-decyne-4,7-diol and an EO adduct thereof.

2,4,7,9-Tetramethyl-5-decyne-4,7-diol, 3,6-dimethyl-4-octyne-3,6-diol and 2,5-dimethyl-3-hexyne-2,5-diol can be synthesized by reacting acetylene with a ketone or an aldehyde corresponding to the aimed acetylene glycol, and may be obtained, for example, by the method described in Takehiko Fujimoto, a fully revised edition "New Introduction to Surfactants" published by Sanyo Chemical Industries, Ltd., 1992, pp. 94-107, etc.

The EO adducts of the acetylene glycol may be produced by subjecting the acetylene glycol obtained by the aforementioned method to addition reaction with EO such that the molar number of addition of EO thereof is adjusted to a desired value.

Specific examples of commercially available products of 2,4,7,9-tetramethyl-5-decyne-4,7-diol include "SURFYNOL 104" (average molar number of addition of EO: 0 mol; active ingredient content: 100% by mass) and "SURFYNOL 104PG-50" (a 50% by mass propylene glycol-diluted solution of 2,4,7,9-tetramethyl-5-decyne-4,7-diol; average molar number of addition of EO: 0 mol) both available from Air Products & Chemicals, Inc. Specific examples of commercially available products of the EO adduct of 2,4,7,9-tetramethyl-5-decyne-4,7-diol include "SURFYNOL 420" (average molar number of addition of EO: 1.3; active ingredient content: 100% by mass) available from Air Products & Chemicals, Inc., etc.

<Compound (B)>

The cleaning liquid of the present invention contains at least one compound (B) selected from the group consisting of the acetylene glycol (b-1) having an average molar number of addition of EO of not less than 4 mol and the polyethylene glycol alkyl ether (b-2) containing an alkyl group having not less than 8 carbon atoms as a surfactant from the viewpoint of improving cleanability for ink and dissolvability of a surfactant in the cleaning liquid.

[Acetylene Glycol (b-1)]

The average molar number of addition of EO of the acetylene glycol (b-1) is not less than 4 mol, preferably not less than 6 mol, more preferably not less than 7 mol and even more preferably not less than 9 mol from the viewpoint of improving dissolvability of a surfactant in the cleaning liquid, and is also preferably not more than 35 mol, more preferably not more than 30 mol, even more preferably not more than 25 mol, further even more preferably not more than 20 mol and still further even more preferably 15 mol from the viewpoint of improving cleanability for ink.

The acetylene glycol (b-1) is preferably at least one compound selected from the group consisting of an EO adduct of 2,4,7,9-tetramethyl-5-decyne-4,7-diol, an EO adduct of 3,6-dimethyl-4-octyne-3,6-diol, an EO adduct of 2,5-dimethyl-3-hexyne-2,5-diol, an EO adduct of 2,5,8,11-tetramethyl-6-dodecyne-5,8-diol and an EO adduct of 3,5-dimethyl-1-hexyne-3-ol, more preferably at least one compound selected from the group consisting of an EO adduct of 2,4,7,9-tetramethyl-5-decyne-4,7-diol, an EO adduct of 3,6-dimethyl-4-octyne-3,6-diol and an EO adduct of 2,5-dimethyl-3-hexyne-2,5-diol, and even more preferably an EO adduct of 2,4,7,9-tetramethyl-5-decyne-4,7-diol.

In addition, examples of commercially available products of the EO adduct of 2,4,7,9-tetramethyl-5-decyne-4,7-diol include "SURFYNOL 465" (average molar number of addition of EO: 10; active ingredient content: 100% by mass) and "SURFYNOL 485" (average molar number of addition of EO: 30; active ingredient content: 100% by mass) both available from Air Products & Chemicals, Inc., and "ACETYLENOL E81" (average molar number of addition of EO: 8.1), "ACETYLENOL E100" (average molar number of addition of EO: 10) and "ACETYLENOL E200" (average molar number of addition of EO: 20) all available from Kawaken Fine Chemicals Co., Ltd., etc.

[Polyethylene Glycol Alkyl Ether (b-2)]

The polyethylene glycol alkyl ether (b-2) is represented by the following formula (1);

$$R^1O\text{-}(EO)_n\text{—}H \quad (1)$$

wherein $R^1$ is an alkyl group having not less than 8 carbon atoms; EO is an ethyleneoxide group; and n is an average molar number of addition of EO.

The number of carbon atoms in $R^1$ as the alkyl group is not less than 8 and preferably not less than 10 from the viewpoint of improving cleanability for ink, and is also preferably not more than 18, more preferably not more than 16, even more preferably not more than 14 and further even more preferably 12 from the viewpoint of improving dissolvability of a surfactant in the cleaning liquid.

$R^1$ as the alkyl group may be in the form of either a straight chain or a branched chain. From the viewpoint of improving cleanability for ink and dissolvability of a surfactant in the cleaning liquid, $R^1$ as the alkyl group is preferably a linear alkyl group, more preferably an octyl group, a decyl group, a dodecyl group, a tetradecyl group, a hexadecyl group or an octadecyl group, even more preferably an octyl group, a decyl group, a dodecyl group, a tetradecyl group or a hexadecyl group, further even more preferably a decyl group, a dodecyl group or a tetradecyl group, and still further even more preferably a dodecyl group.

The average molar number n of addition of EO in the aforementioned formula (1) is preferably not less than 4, more preferably not less than 8 and even more preferably not less than 10 from the viewpoint of improving dissolvability of a surfactant in the cleaning liquid, and is also preferably not more than 30, more preferably not more than 25 and even more preferably not more than 20 from the viewpoint of improving cleanability for ink.

Specific examples of the polyethylene glycol alkyl ether (b-2) represented by the aforementioned formula (1) include polyethylene glycol mono-2-ethylhexyl ether, polyethylene glycol monooctyl ether, polyethylene glycol monodecyl ether, polyethylene glycol monododecyl ether and polyethylene glycol monotetradecyl ether.

Among these polyethylene glycol alkyl ethers, from the viewpoint of improving cleanability for ink, preferred is at least one compound selected from the group consisting of polyethylene glycol monodecyl ether and polyethylene glycol monododecyl ether, and more preferred is polyethylene glycol monododecyl ether.

Examples of commercially available products of the polyethylene glycol alkyl ether (b-2) include "NOIGEN" available from DKS Co., Ltd., "EMULGEN" available from Kao Corporation, etc.

From the viewpoint of obtaining a cleaning liquid that is excellent in cleanability for ink and dissolvability of a surfactant therein and hardly remains on a member to be cleaned, the cleaning liquid of the present invention preferably contains a combination of the acetylene glycol (A) and the acetylene glycol (b-1) or a combination of the acetylene glycol (A) and the polyethylene glycol alkyl ether (b-2), and more preferably contains a combination of the acetylene glycol (A) and the polyethylene glycol alkyl ether (b-2).

<Water-Soluble Organic Solvent (C)>

The water-soluble organic solvent (C) used in the present invention (hereinafter also referred to merely as a "component (C)") contains at least one water-soluble organic solvent having a boiling point of not lower than 90° C., and the boiling point of the water-soluble organic solvent (C) is not higher than 250° C. in terms of a weighted mean value of boiling points of respective water-soluble organic solvents contained therein which are weighted by contents (% by mass) of the respective water-soluble organic solvents. By incorporating the water-soluble organic solvent (C) into the cleaning liquid, the resulting cleaning liquid is prevented from being dried, and exhibits good compatibility with the water-based ink, and is improved in cleanability for ink. In addition, the cleaning liquid containing the water-soluble organic solvent (C) hardly remains on a member to be cleaned.

Meanwhile, the "water-soluble organic solvent" as used in the present invention means an organic solvent having a solubility in water of not less than 10 mL as measured by dissolving the organic solvent in 100 mL of water at 25° C.

The boiling point of the water-soluble organic solvent (C) in terms of a weighted mean value thereof is preferably not lower than 150° C., more preferably not lower than 160° C., even more preferably not lower than 170° C. and further even more preferably not lower than 180° C. from the viewpoint of preventing the cleaning liquid from being dried, and is also preferably not higher than 240° C., more preferably not higher than 230° C., even more preferably not higher than 220° C. and further even more preferably not higher than 210° C. from the viewpoint of obtaining a cleaning liquid that hardly remains on a member to be cleaned.

As the boiling point of the organic solvent is lowered, the saturated vapor pressure of the organic solvent as measured at a specific temperature is increased, so that the evaporation rate of the organic solvent as measured at the specific temperature is also increased. In addition, as the content of the organic solvent having a high evaporation rate as measured at a specific temperature in a mixed organic solvent is increased, the evaporation rate of the mixed organic solvent as measured at the specific temperature is also increased. For this reason, the weighted mean value thus calculated serves as an index of the evaporation rate of the mixed organic solvent.

Examples of the water-soluble organic solvent (C) include a polyhydric alcohol, a polyhydric alcohol alkyl ether other than the polyethylene glycol alkyl ether (b-2), a nitrogen-containing heterocyclic compound, an amide, an amine and a sulfur-containing compound. The polyhydric alcohol may be used in the form of a mixed alcohol containing a plurality of compounds belonging to the concept of the polyhydric alcohol, and the polyhydric alcohol alkyl ether may also be used in the form of a mixed ether containing a plurality of compounds belonging to the concept of the polyhydric alcohol alkyl ether.

Examples of the polyhydric alcohol include ethylene glycol (boiling point (b.p.) 197° C.), diethylene glycol (b.p. 244° C.), polyethylene glycol, propylene glycol (b.p. 188° C.), dipropylene glycol (b.p. 232° C.), polypropylene glycol, 1,3-propanediol (b.p. 210° C.), 1,3-butanediol (b.p. 208° C.), 1,4-butanediol (b.p. 230° C.), 3-methyl-1,3-butanediol (b.p. 203° C.), 1,5-pentanediol (b.p. 242° C.), 2-methyl-2,4-pentanediol (b.p. 196° C.), 1,2,6-hexanetriol (b.p. 178° C.), 1,2,4-butanetriol (b.p. 190° C.), 1,2,3-butanetriol (b.p. 175° C.) and petriol (b.p. 216° C.). In addition, 1,6-hexanediol (b.p. 250° C.), triethylene glycol (b.p. 285° C.), tripropylene glycol (b.p. 273° C.), glycerin (b.p. 290° C.) and the like may be used in combination with the compound having a boiling point of lower than 250° C.

As the aforementioned polyhydric alcohol alkyl ether, there may be mentioned alkylene glycol monoalkyl ethers, dialkylene glycol monoalkyl ethers, trialkylene glycol monoalkyl ethers and the like. Specific examples of the polyhydric alcohol alkyl ether include ethylene glycol monoethyl ether (b.p. 135° C.), ethylene glycol monobutyl ether (b.p. 171° C.), diethylene glycol monomethyl ether (b.p. 194° C.), diethylene glycol monoethyl ether (b.p. 202° C.), diethylene glycol monobutyl ether (b.p. 230° C.), triethylene glycol monomethyl ether (b.p. 122° C.), triethylene glycol monoisobutyl ether (b.p. 160° C.), tetraethylene glycol monomethyl ether (b.p. 158° C.), propylene glycol monoethyl ether (b.p. 133° C.), dipropylene glycol monomethyl ether (b.p. 90° C.), dipropylene glycol monobutyl ether (b.p. 227° C.), tripropylene glycol monomethyl ether (b.p. 100° C.) and tripropylene glycol monobutyl ether. In addition, triethylene glycol monobutyl ether (b.p. 276° C.) and the like may be used in combination with the compound having a boiling point of lower than 250° C.

Examples of the nitrogen-containing heterocyclic compound include N-methyl-2-pyrrolidone (b.p. 202° C.), 2-pyrrolidone (b.p. 245° C.), 1,3-dimethyl imidazolidinone (b.p. 220° C.) and ε-caprolactam (b.p. 136° C.).

Examples of the amide include formamide (b.p. 210° C.), N-methylformamide (b.p. 199° C.) and N,N-dimethylformamide (b.p. 153° C.).

Examples of the amine include monoethanolamine (b.p. 170° C.), diethanolamine (b.p. 217° C.), triethanolamine (b.p. 208° C.) and triethylamine (b.p. 90° C.).

Examples of the sulfur-containing compound include dimethyl sulfoxide (b.p. 189° C.) and the like. In addition, sulfolane (b.p. 285° C.) and thiodiglycol (b.p. 282° C.), etc., may be used in combination with the compound having a boiling point of lower than 250° C.

Among these water-soluble organic solvents, from the viewpoint of obtaining a cleaning liquid that is excellent in cleanability for ink and hardly remains on a member to be cleaned, preferred is at least one compound selected from the group consisting of a polyhydric alcohol and a polyhydric alcohol alkyl ether other than the polyethylene glycol alkyl ether (b-2), and more preferred is at least one compound selected from the group consisting of propylene glycol, diethylene glycol and diethylene glycol monobutyl ether. From the viewpoint of obtaining a cleaning liquid that hardly remains on a member to be cleaned, preferred is at least one compound selected from the group consisting of propylene glycol and diethylene glycol monobutyl ether, and more preferred is a combination of propylene glycol and diethylene glycol monobutyl ether.

(Other Components)

In the cleaning liquid of the present invention, in addition to the aforementioned components, various additives other than the components (A) and (B), such as a surfactant, a pH modifier, a defoaming agent, an antiseptic agent, a mildewproof agent and a rust preventive may be further added thereto.

Incidentally, the cleaning liquid of the present invention contains neither a pigment nor a polymer.

[Process for Producing Cleaning Liquid for Water-Based Ink]

The cleaning liquid of the present invention may be produced by compounding the acetylene glycol (A), the compound (B), the water-soluble organic solvent (C) and water. More specifically, the cleaning liquid of the present invention may be obtained by mixing the acetylene glycol (A), the compound (B), the water-soluble organic solvent (C) and water, if required together with the aforementioned additives, and stirring the resulting mixture.

The contents of the respective components in the cleaning liquid of the present invention as well as properties of the cleaning liquid are as follows.

Meanwhile, the preferred amounts of the respective components compounded in the cleaning liquid of the present invention are the same as the following contents of the respective components in the cleaning liquid.

(Content of Acetylene Glycol (A))

The content of the acetylene glycol (A) in the cleaning liquid is preferably not less than 0.01% by mass, more preferably not less than 0.05% by mass, even more preferably not less than 0.1% by mass and further even more preferably not less than 0.3% by mass from the viewpoint of improving cleanability for ink, and is also preferably not more than 5% by mass, more preferably not more than 3% by mass, even more preferably not more than 1% by mass and further even more preferably not more than 0.7% by mass from the viewpoint of improving dissolvability of a surfactant in the cleaning liquid.

(Content of Compound (B))

The content of the compound (B) in the cleaning liquid is preferably not less than 0.01% by mass, more preferably not less than 0.05% by mass, even more preferably not less than 0.1% by mass and further even more preferably not less than 0.3% by mass from the viewpoint of improving dissolvability of a surfactant in the cleaning liquid, and is also preferably not more than 5% by mass, more preferably not more than 3% by mass, even more preferably not more than 1% by mass and further even more preferably not more than 0.7% by mass from the viewpoint of improving cleanability for ink.

(Mass Ratio of Acetylene Glycol (A) to Compound (B) [Component (A)/Component (B)])

The mass ratio of the acetylene glycol (A) to the compound (B) [component (A)/component (B)] (i.e., a mass ratio [(A)/(B)]) is preferably not less than 0.1, more preferably not less than 0.5 and even more preferably not less than 0.7 from the viewpoint of improving cleanability for ink, and is also preferably not more than 2, more preferably not more than 1.5 and even more preferably not more than 1.3 from the viewpoint of improving dissolvability of a surfactant in the cleaning liquid.

(Total Content of Acetylene Glycol (A) and Compound (B))

The total content of the acetylene glycol (A) and the compound (B) in the cleaning liquid is preferably not less than 0.3% by mass, more preferably not less than 0.5% by mass and even more preferably not less than 0.7% by mass from the viewpoint of improving cleanability for ink, and is also preferably not more than 10% by mass, more preferably not more than 5% by mass, even more preferably not more than 3% by mass and further even more preferably not more than 1.5% by mass from the viewpoint of improving dissolvability of a surfactant in the cleaning liquid.

(Content of Water-Soluble Organic Solvent (C))

The content of the water-soluble organic solvent (C) in the cleaning liquid is not more than 20% by mass, preferably not more than 15% by mass, more preferably not more than 10% by mass and even more preferably not more than 7% by mass from the viewpoint of improving cleanability for ink and dissolvability of a surfactant in the cleaning liquid as well as from the viewpoint of obtaining a cleaning liquid that hardly remains on a member to be cleaned, and is also preferably not less than 1% by mass, more preferably not less than 3% by mass and even more preferably not less than 5% by mass from the same viewpoint as described above.

In the case where at least one compound selected from the group consisting of a polyhydric alcohol and a polyhydric alcohol alkyl ether other than the polyethylene glycol alkyl ether (b-2) is used as the water-soluble organic solvent (C), the total content of the polyhydric alcohol and the polyhydric alcohol alkyl ether in the water-soluble organic solvent (C) is preferably not less than 80% by mass, more preferably not less than 90% by mass, even more preferably not less than 95% by mass, further even more preferably substantially 100% by mass and still further even more preferably 100% by mass.

As the water-soluble organic solvent (C), preferred is a combination of the polyhydric alcohol and the polyhydric alcohol alkyl ether other than the polyethylene glycol alkyl ether (b-2). In this case, the mass ratio of the polyhydric alcohol to the polyhydric alcohol alkyl ether other than the polyethylene glycol alkyl ether (b-2) [polyhydric alcohol/polyhydric alcohol alkyl ether other than polyethylene glycol alkyl ether (b-2)] is preferably not less than 0.8, more preferably not less than 0.9, even more preferably not less than 1.0 and further even more preferably not less than 1.1, and is also preferably not more than 2, more preferably not more than 1.8, even more preferably not more than 1.6 and further even more preferably not more than 1.4.

(Content of Water)

The content of water in the cleaning liquid is preferably not less than 60% by mass, more preferably not less than 70% by mass, even more preferably not less than 80% by mass and further even more preferably not less than 90% by mass from the viewpoint of enhancing productivity of the cleaning liquid, and is also preferably not more than 98% by mass and more preferably not more than 95% by mass from the viewpoint of improving cleanability for ink.

(Properties of Cleaning Liquid)

The viscosity of the cleaning liquid as measured at 25° C. is preferably not less than 0.9 mPa·s, more preferably not less than 1.0 mPa·s and even more preferably not less than 1.05 mPa·s from the viewpoint of improving cleanability for ink, and is also preferably not more than 5 mPa·s, more preferably not more than 4 mPa·s and even more preferably not more than 3 mPa·s from the viewpoint of obtaining a cleaning liquid that hardly remains on a member to be cleaned.

Meanwhile, the viscosity at 25° C. of the cleaning liquid may be measured by the method described in Examples below.

The pH value of the cleaning liquid is preferably not less than 7.0, more preferably not less than 8.0 and even more preferably not less than 8.5, and is also preferably not more than 11.0 and more preferably not more than 10.0 from the viewpoint of improving resistance of a member to be cleaned to the cleaning liquid as well as from the viewpoint of suppressing skin irritation by the cleaning liquid, the pH value of the cleaning liquid.

Meanwhile, the pH value of the cleaning liquid may be measured by the method described in Examples below.

The cleaning liquid of the present invention is excellent in cleanability for ink and dissolvability of a surfactant therein, and hardly remains on a member to be cleaned. Therefore, the cleaning liquid of the present invention may be suitably used as a cleaning liquid for cleaning a water-based ink that contains a pigment and a water-insoluble polymer, more specifically, may also be used as a cleaning liquid for a water-based ink for flexographic printing, a water-based ink for gravure printing or a water-based ink for ink-jet printing. In particular, the cleaning liquid of the present invention is preferably used as a cleaning liquid for cleaning a water-based ink for gravure printing or a water-based ink for ink-jet printing because the cleaning liquid is excellent in cleanability for ink and hardly remains on a member to be cleaned.

<Water-Based Ink>

The pigment contained in the water-based ink may be either an inorganic pigment or an organic pigment. The inorganic or organic pigment may also be used in combination with an extender pigment, if required.

Specific examples of the inorganic pigment include carbon blacks, metal oxides and the like. Of these inorganic pigments, in particular, carbon blacks are preferably used for black inks. The carbon blacks may include furnace blacks, thermal lamp blacks, acetylene blacks and channel blacks.

Specific examples of the organic pigment include azo pigments, diazo pigments, phthalocyanine pigments, quinacridone pigments, isoindolinone pigments, dioxazine pigments, perylene pigments, perinone pigments, thioindigo pigments, anthraquinone pigments and quinophthalone pigments.

The hue of the organic pigment used in the present invention is not particularly limited, and there may be used any chromatic pigment having a yellow color, a magenta color, a cyan color, a blue color, a red color, an orange color, a green color, etc.

Specific examples of the preferred organic pigments include one or more pigments selected from the group consisting of commercially available products marketed under the names of C.I. Pigment Yellow, C.I. Pigment Red, C.I. Pigment Orange, C.I. Pigment Violet, C.I. Pigment Blue and C.I. Pigment Green with various part numbers.

Examples of the extender pigment include silica, calcium carbonate and talc.

The pigment may be contained in the water-based ink in the form of a self-dispersible pigment, a pigment dispersed in the water-based ink with a dispersant, or pigment-containing water-insoluble polymer particles (hereinafter also referred to merely as "pigment-containing polymer particles").

The water-insoluble polymer contained in the water-based ink has at least any one of a function as a pigment dispersant capable of exhibiting the effect of dispersing the pigment in the water-based ink, and a function as a fixing agent for fixing the water-based ink on a printing medium.

The term "water-insoluble" as used herein means that when a polymer is dried to a constant weight at 105° C. for 2 hours and then dissolved in 100 g of water at 25° C., the solubility in water of the polymer is not more than 10 g. The solubility in water of the water-insoluble polymer is preferably not more than 5 g and more preferably not more than 1 g. In the case where the water-insoluble polymer is in the form of an anionic polymer, the solubility means a solubility in water of the water-insoluble polymer whose anionic groups are neutralized completely (i.e., 100%) with sodium hydroxide. On the other hand, in the case where the water-insoluble polymer is in the form of a cationic polymer, the solubility means a solubility in water of the water-insoluble polymer whose cationic groups are neutralized completely (i.e., 100%) with hydrochloric acid.

Examples of the water-insoluble polymer used in the present invention include polyesters, polyurethanes and vinyl-based polymers. Among these water-insoluble polymers, from the viewpoint of improving ejection stability of the water-based ink, preferred are vinyl-based polymers obtained by addition-polymerizing a vinyl monomer (such as vinyl compounds, vinylidene compounds and vinylene compounds).

In the case where the water-insoluble polymer is in the form of a vinyl-based polymer, the vinyl-based polymer preferably contains one or more constitutional units selected from the group consisting of a constitutional unit derived from an ionic monomer, a constitutional unit derived from a hydrophobic monomer and a constitutional unit derived from a hydrophilic nonionic monomer, and more preferably contains two or more constitutional units selected from the group consisting of the aforementioned constitutional units. Examples of a combination of the monomers from which the two or more constitutional units are derived include a combination of the ionic monomer and the hydrophobic monomer and a combination of the ionic monomer, the hydrophobic monomer and the hydrophilic nonionic monomer.

The vinyl-based polymer used in the present invention may be produced, for example, by subjecting a monomer mixture containing the ionic monomer, the hydrophobic monomer and the hydrophilic nonionic monomer to addition polymerization by conventionally known methods.

Examples of the ionic monomer include anionic monomers such as carboxylic acid monomers, sulfonic acid monomers and phosphoric acid monomers; and cationic monomers such as N,N-dimethylaminoethyl methacrylate and N,N-dimethylaminoethyl acrylamide. Meanwhile, the ionic monomer may also include those monomers that have no ionicity under neutral conditions, such as acids and amines, but are converted into ions under acid or alkaline conditions.

Examples of the hydrophobic monomer include an alkyl (meth)acrylate having not less than 1 and not more than 22 carbon atoms, a styrene-based monomer, an aromatic group-containing (meth)acrylate and a styrene-based macromonomer. The styrene-based macromonomer is a compound containing a polymerizable functional group at one terminal end thereof and having a number-average molecular weight of not less than 500 and not more than 100,000.

Examples of the hydrophilic nonionic monomer include polyalkylene glycol (meth)acrylates such as polyethylene glycol mono(meth)acrylate; and alkoxy polyalkylene glycol mono(meth)acrylates such as methoxy polyethylene glycol mono(meth)acrylate and octoxy polyethylene glycol mono (meth)acrylate.

The water-insoluble polymer contained in the ink is preferably in the form of pigment-containing polymer particles or pigment-free polymer particles. The cleaning liquid of the present invention is excellent in cleanability for ink and dissolvability of a surfactant therein, and hardly remains in a member to be cleaned. Therefore, the cleaning liquid of the present invention is able to more remarkably exhibit its effects when used for cleaning a water-based ink containing the pigment-containing polymer particles or pigment-free polymer particles.

The water-based ink preferably contains the pigment-containing polymer particles from the viewpoint of improving dispersion stability and ejection stability of the ink. The pigment-containing polymer particles have any configuration as long as the particles are formed of the pigment and the water-insoluble polymer. In the ink, the water-insoluble polymer is adsorbed onto the pigment to form the pigment-containing polymer particles. Examples of the configuration of the pigment-containing polymer particles in the ink include the particle configuration in which the pigment is enclosed (encapsulated) in the water-insoluble polymer, the particle configuration in which the pigment is uniformly dispersed in the water-insoluble polymer, the particle configuration in which the pigment is exposed to the surface of the respective polymer particles, and the mixed configuration of these configurations.

The pigment-containing polymer particles may be obtained by subjecting the pigment and the water-insoluble polymer, if required together with a neutralizing agent, a surfactant, etc., to dispersion treatment by conventionally known methods.

The water-based ink also preferably contains the pigment-free water-insoluble polymer particles from the viewpoint of improving fixing properties of the ink on a printing medium and rub fastness of printed characters or images. Furthermore, from the viewpoint of improving dispersion stability and ejection stability of the ink as well as from the viewpoint of improving fixing properties of the ink on a printing medium and rub fastness of printed characters or images, the water-based ink more preferably contains both the pigment-containing polymer particles and the pigment-free water-insoluble polymer particles.

The pigment-free water-insoluble polymer particles are preferably used in the form of a dispersion thereof from the viewpoint of improving handling properties thereof, and may be either a synthesized product obtained by emulsion polymerization, etc., or a commercially available product. Examples of commercially available products of the dispersion of the pigment-free water-insoluble polymer particles include dispersions of acrylic resins such as "Neocryl A1127" (anionic self-crosslinkable aqueous acrylic resin) available from DSM NeoResins, Inc., and "JONCRYL 390" available from BASF Japan, Ltd.; urethane-based resins such as "WBR-2018" and "WBR-2000U" both available from Taisei Fine Chemical Co., Ltd.; styrene-butadiene resins such as "SR-100" and "SR102" both available from Nippon A & L Inc.; styrene-acrylic resins such as "JONCRYL 7100", "JONCRYL 734" and "JONCRYL 538" all available from BASF Japan, Ltd.; and vinyl chloride-based resins such as "VINYBLAN 701" available from Nissin Chemical Co., Ltd., etc.

In the case where the ink contains the pigment-containing polymer particles, the weight-average molecular weight of the water-insoluble polymer constituting the pigment-containing polymer particles is preferably not less than 5,000, more preferably not less than 10,000 and even more preferably not less than 20,000, and is also preferably not more than 500,000, more preferably not more than 400,000, even more preferably not more than 300,000, further even more preferably not more than 200,000 and still further even more preferably not more than 100,000.

In the case where the ink contains the pigment-free water-insoluble polymer particles, the weight-average molecular weight of the water-insoluble polymer constituting the pigment-free water-insoluble polymer particles is preferably not less than 100,000, more preferably not less than 200,000, even more preferably not less than 300,000 and further even more preferably not less than 500,000, and is also preferably not more than 2,000,000, more preferably not more than 1,500,000, even more preferably not more than 1,000,000 and further even more preferably not more than 800,000.

The water-based ink contains the pigment, the water-insoluble polymer and water, and may further contain an organic solvent, if required. In addition, the water-based ink may also contain, as optional components, various additives such as a humectant, a wetting agent, a penetrant, a dispersant, a surfactant, a viscosity controller, a defoaming agent, an antiseptic agent, a mildew-proof agent and a rust preventive.

(Method for Producing Water-Based Ink)

The water-based ink may be produced by mixing the pigment, the water-insoluble polymer and water, if required together with a neutralizing agent, a surfactant, an organic solvent, etc., and then stirring the resulting mixture.

The contents of the respective components in the water-based ink are as follows. In the case where the water-based ink contains the pigment-containing polymer particles, after previously subjecting the pigment and the water-insoluble polymer to dispersion treatment to obtain a dispersion of the pigment-containing polymer particles, the resulting dispersion may be compounded in the water-based ink.

(Content of Pigment)

The content of the pigment in the water-based ink is preferably not less than 1% by mass, more preferably not less than 2% by mass and even more preferably not less than 3% by mass from the viewpoint of enhancing optical density of the resulting printed characters or images, and is also preferably not more than 15% by mass, more preferably not more than 10% by mass, even more preferably not more than 8% by mass and further even more preferably not more than 6% by mass from the viewpoint of improving viscosity of the ink and rub fastness of the resulting printed characters or images.

(Content of Water-Insoluble Polymer)

The content of the water-insoluble polymer in the water-based ink is preferably not less than 0.5% by mass, more preferably not less than 1% by mass, even more preferably not less than 2% by mass and further even more preferably not less than 3% by mass from the viewpoint of improving fixing properties of the ink on a printing medium and rub fastness of the resulting printed characters or images, and is also preferably not more than 10% by mass, more preferably not more than 8% by mass and even more preferably not more than 6% by mass from the viewpoint of improving viscosity of the ink.

Meanwhile, in the case where the water-based ink contains both the pigment-containing polymer particles and the pigment-free polymer particles, the content of the water-insoluble polymer in the water-based ink means a total content of the water-insoluble polymer contained in the pigment-containing polymer particles and the water-insoluble polymer contained in the pigment-free polymer particles.

(Content of Water)

The content of water in the water-based ink is preferably not less than 30% by mass, more preferably not less than 40% by mass and even more preferably not less than 50% by mass from the viewpoint of improving rub fastness of the resulting printed characters or images and ejection stability of the ink, and is also preferably not more than 80% by mass, more preferably not more than 75% by mass and even more preferably not more than 70% by mass from the viewpoint of improving ejection stability of the ink.

[Method of Cleaning Water-Based Ink]

The method of cleaning the water-based ink according to the present invention includes the step of allowing the water-based ink that contains the pigment and the water-insoluble polymer to come into contact with the aforementioned cleaning liquid. As the contacting method between the water-based ink and the cleaning liquid, there may be used a coating method, a spraying method and a dipping method, etc.

Examples of the method of cleaning the water-based ink include a method in which the aforementioned cleaning liquid is impregnated into a wiping member such as a nonwoven fabric, and a surplus amount of the ink deposited on an end face or an ink ejection port of respective nozzles is wiped off with the wiping member; a method in which in the case of using different kinds of inks, an ink path within an ink-jet printer is cleaned with the cleaning liquid before or after changing the ink to be used from one to another, by repeating supply of the cleaning liquid accommodated in a cartridge into the ink path and discharge of the cleaning liquid from the ink path using a feed mechanism and a withdrawal mechanism of the ink-jet printer; and a method in which when allowing a print head to remain in an unused state for a long period of time, the ink is withdrawn from the print head, and the print head is filled with the cleaning liquid and closed by capping for storage. Among these methods, from the viewpoint of obtaining a cleaning liquid that hardly remain on a member to be cleaned, preferred is the method in which the aforementioned cleaning liquid is impregnated into a wiping member, and a surplus amount of the ink deposited on an end face or an ink ejection port of the respective nozzles is wiped off with the wiping member. The wiping member used in the aforementioned method is not particularly limited as long as the member is capable of exhibiting good liquid absorbing properties. Examples of the wiping member include cloths such as a woven fabric, a knitted fabric and a nonwoven fabric, sponges and pulps.

With respect to the aforementioned embodiments, the present invention further provides the following aspects relating to the cleaning liquid for a water-based ink, the process for producing the cleaning liquid, and the cleaning method using the cleaning liquid.

<1> A cleaning liquid for a water-based ink that contains a pigment and a water-insoluble polymer, said cleaning liquid containing (A) an acetylene glycol having an average molar number of addition of ethyleneoxide of not less than 0 mol and not more than 2 mol, (B) at least one compound selected from the group consisting of (b-1) an acetylene glycol having an average molar number of addition of ethyleneoxide of not less than 4 mol and (b-2) a polyethylene glycol alkyl ether containing an alkyl group having not less than 8 carbon atoms, (C) a water-soluble organic solvent and water, in which the water-soluble organic solvent (C) contains at least one water-soluble organic solvent having a boiling point of not lower than 90° C.;

a boiling point of the water-soluble organic solvent (C) is not higher than 250° C. in terms of a weighted mean value of boiling points of respective water-soluble organic solvents contained therein which are weighted by contents (% by mass) of the respective water-soluble organic solvents; and a content of the water-soluble organic solvent (C) in the cleaning liquid is not more than 20% by mass.

<2> The cleaning liquid for a water-based ink according to the above aspect <1>, wherein the average molar number of addition of ethyleneoxide of the acetylene glycol (A) is preferably not more than 1.5 mol, more preferably not more than 1 mol and even more preferably 0.

<3> The cleaning liquid for a water-based ink according to the above aspect <1> or <2>, wherein the acetylene glycol (A) is preferably at least one compound selected from the group consisting of 2,4,7,9-tetramethyl-5-decyne-4,7-diol, 3,6-dimethyl-4-octyne-3,6-diol, 2,5-dimethyl-3-hexyne-2,5-diol, 2,5,8,11-tetramethyl-6-dodecyne-5,8-diol, 3,5-dimethyl-1-hexyne-3-ol and EO adducts of these compounds, more preferably at least one compound selected from the group consisting of 2,4,7,9-tetramethyl-5-decyne-4,7-diol, 3,6-dimethyl-4-octyne-3,6-diol, 2,5-dimethyl-3-hexyne-2,5-diol and EO adducts of these compounds, and even more preferably at least one compound selected from the group consisting of 2,4,7,9-tetramethyl-5-decyne-4,7-diol and an EO adduct of the compound.

<4> The cleaning liquid for a water-based ink according to any one of the above aspects <1> to <3>, wherein the average molar number of addition of ethyleneoxide of the acetylene glycol (b-1) is preferably not less than 6 mol, more preferably not less than 7 mol and even more preferably not less than 9 mol, and is also preferably not more than 35 mol, more preferably not more than 30 mol, even more preferably not more than 25 mol, further even more preferably not more than 20 mol and still further even more preferably not more than 15 mol.

<5> The cleaning liquid for a water-based ink according to any one of the above aspects <1> to <4>, wherein the acetylene glycol (b-1) is preferably at least one compound selected from the group consisting of an EO adduct of 2,4,7,9-tetramethyl-5-decyne-4,7-diol, an EO adduct of 3,6-dimethyl-4-octyne-3,6-diol, an EO adduct of 2,5-dimethyl-3-hexyne-2,5-diol, an EO adduct of 2,5,8,11-tetramethyl-6-dodecyne-5,8-diol and an EO adduct of 3,5-dimethyl-1-hexyne-3-ol, more preferably at least one compound selected from the group consisting of an EO adduct of 2,4,7,9-tetramethyl-5-decyne-4,7-diol, an EO adduct of 3,6-dimethyl-4-octyne-3,6-diol and an EO adduct of 2,5-dimethyl-3-hexyne-2,5-diol, and even more preferably an EO adduct of 2,4,7,9-tetramethyl-5-decyne-4,7-diol.

<6> The cleaning liquid for a water-based ink according to any one of the above aspects <1> to <5>, wherein the polyethylene glycol alkyl ether (b-2) is preferably represented by the following formula (1):

$$R^1O\text{-}(EO)_n\text{—}H \quad (1)$$

wherein $R^1$ is an alkyl group having not less than 8 carbon atoms; EO is an ethyleneoxide group; and n is an average molar number of addition of EO.

<7> The cleaning liquid for a water-based ink according to the above aspect <6>, wherein the number of carbon atoms in $R^1$ as the alkyl group in the aforementioned formula (1) is preferably not less than 10, and is also preferably not more than 18, more preferably not more than 16, even more preferably not more than 14 and further even more preferably 12.

<8> The cleaning liquid for a water-based ink according to the above aspect <6> or <7>, wherein $R^1$ as the alkyl group in the aforementioned formula (1) is preferably a linear alkyl group, more preferably an octyl group, a decyl group, a dodecyl group, a tetradecyl group, a hexadecyl group or an octadecyl group, even more preferably an octyl group, a decyl group, a dodecyl group, a tetradecyl group or a hexadecyl group, further even more preferably a decyl group, a dodecyl group or a tetradecyl group, and still further even more preferably a dodecyl group.

<9> The cleaning liquid for a water-based ink according to any one of the above aspects <6> to <8>, wherein the average molar number n of addition of EO in the aforementioned formula (1) is preferably not less than 4, more preferably not less than 8 and even more preferably not less than 10, and is also preferably not more than 30, more preferably not more than 25 and even more preferably not more than 20.

<10> The cleaning liquid for a water-based ink according to any one of the above aspects <6> to <9>, wherein the polyethylene glycol alkyl ether (b-2) represented by the aforementioned formula (1) is preferably at least one compound selected from the group consisting of polyethylene glycol mono-2-ethylhexyl ether, polyethylene glycol monooctyl ether, polyethylene glycol monodecyl ether, polyethylene glycol monododecyl ether and polyethylene glycol monotetradecyl ether, more preferably at least one compound selected from the group consisting of polyethylene glycol monodecyl ether and polyethylene glycol monododecyl ether, and even more preferably polyethylene glycol monododecyl ether.

<11> The cleaning liquid for a water-based ink according to any one of the above aspects <1> to <10>, wherein a content of the acetylene glycol (A) in the cleaning liquid is preferably not less than 0.01% by mass, more preferably not less than 0.05% by mass, even more preferably not less than 0.1% by mass and further even more preferably not less than 0.3% by mass, and is also preferably not more than 5% by mass, more preferably not more than 3% by mass, even more preferably not more than 1% by mass and further even more preferably not more than 0.7% by mass.

<12> The cleaning liquid for a water-based ink according to any one of the above aspects <1> to <11>, wherein a content of the compound (B) in the cleaning liquid is preferably not less than 0.01% by mass, more preferably not less than 0.05% by mass, even more preferably not less than 0.1% by mass and further even more preferably not less than 0.3% by mass, and is also preferably not more than 5% by mass, more preferably not more than 3% by mass, even more preferably not more than 1% by mass and further even more preferably not more than 0.7% by mass.

<13> The cleaning liquid for a water-based ink according to any one of the above aspects <1> to <12>, wherein a mass ratio of the acetylene glycol (A) to the compound (B) [component (A)/component (B)] (i.e., a mass ratio [(A)/(B)]) is preferably not less than 0.1, more preferably not less than 0.5 and even more preferably not less than 0.7, and is also preferably not more than 2, more preferably not more than 1.5 and even more preferably not more than 1.3.

<14> The cleaning liquid for a water-based ink according to any one of the above aspects <1> to <13>, wherein a total content of the acetylene glycol (A) and the compound (B) in the cleaning liquid is preferably not less than 0.3% by mass, more preferably not less than 0.5% by mass and even more preferably not less than 0.7% by mass, and is also preferably not more than 10% by mass, more preferably not more than 5% by mass, even more preferably not more than 3% by mass and further even more preferably not more than 1.5% by mass.

<15> The cleaning liquid for a water-based ink according to any one of the above aspects <1> to <14>, wherein the water-soluble organic solvent (C) is preferably at least one compound selected from the group consisting of a polyhydric alcohol and a polyhydric alcohol alkyl ether other than the polyethylene glycol alkyl ether (b-2) containing an alkyl group having not less than 8 carbon atoms, more preferably at least one compound selected from the group consisting of propylene glycol, diethylene glycol and diethylene glycol monobutyl ether, even more preferably at least one compound selected from the group consisting of propylene glycol and diethylene glycol monobutyl ether, and further even more preferably a combination of propylene glycol and diethylene glycol monobutyl ether.

<16> The cleaning liquid for a water-based ink according to any one of the above aspects <1> to <14>, wherein the water-soluble organic solvent (C) is preferably a combination of the polyhydric alcohol and the polyhydric alcohol alkyl ether other than the polyethylene glycol alkyl ether (b-2), and a mass ratio of the polyhydric alcohol to the polyhydric alcohol alkyl ether other than the polyethylene glycol alkyl ether (b-2) [polyhydric alcohol/polyhydric alcohol alkyl ether other than polyethylene glycol alkyl ether (b-2)] is preferably not less than 0.8, more preferably not less than 0.9, even more preferably not less than 1.0 and further even more preferably not less than 1.1, and is also preferably not more than 2, more preferably not more than 1.8, even more preferably not more than 1.6 and further even more preferably not more than 1.4.

<17> The cleaning liquid for a water-based ink according to any one of the above aspects <1> to <16>, wherein a content of the water-soluble organic solvent (C) in the cleaning liquid is preferably not more than 15% by mass, more preferably not more than 10% by mass and even more preferably not more than 7% by mass, and is also preferably not less than 1% by mass, more preferably not less than 3% by mass and even more preferably not less than 5% by mass.

<18> A method of cleaning a water-based ink including the step of allowing a water-based ink that contains a pigment and a water-insoluble polymer to come into contact with the cleaning liquid according to any one of the above aspects <1> to <17>.

<19> The method of cleaning a water-based ink according to the above aspect <18>, wherein the water-based ink is used for gravure printing or ink-jet printing.

<20> A use of the cleaning liquid according to any one of the above aspects <1> to <17> as a cleaning liquid for gravure printing or as a cleaning liquid for ink-jet printing.

<21> A process for producing a cleaning liquid for a water-based ink, including the step of compounding (A) an acetylene glycol having an average molar number of addition of ethyleneoxide of not less than 0 mol and not more than 2 mol, (B) at least one compound selected from the group consisting of (b-1) an acetylene glycol having an average molar number of addition of ethyleneoxide of not less than 4 mol and (b-2) a polyethylene glycol alkyl ether containing an alkyl group having not less than 8 carbon atoms, (C) a water-soluble organic solvent and water, in which the water-soluble organic solvent (C) contains at least one water-soluble organic solvent having a boiling point of not lower than 90° C.;

a boiling point of the water-soluble organic solvent (C) is not higher than 250° C. in terms of a weighted mean value of boiling points of respective water-soluble organic solvents contained therein which are weighted by contents (% by mass) of the respective water-soluble organic solvents; and a content of the water-soluble organic solvent (C) in the cleaning liquid is not more than 20% by mass.

<22> The process for producing a cleaning liquid for a water-based ink according to the above aspect <21>, wherein an amount of the acetylene glycol (A) compounded in the cleaning liquid is preferably not less than 0.01% by mass, more preferably not less than 0.05% by mass, even more preferably not less than 0.1% by mass and further even more preferably not less than 0.3% by mass, and is also preferably not more than 5% by mass, more preferably not more than 3% by mass, even more preferably not more than 1% by mass and further even more preferably not more than 0.7% by mass.

<23> The process for producing a cleaning liquid for a water-based ink according to the above aspect <21> or <22>, wherein an amount of the compound (B) compounded in the cleaning liquid is preferably not less than 0.01% by mass, more preferably not less than 0.05% by mass, even more preferably not less than 0.1% by mass and further even more preferably not less than 0.3% by mass, and is also preferably not more than 5% by mass, more preferably not more than 3% by mass, even more preferably not more than 1% by mass and further even more preferably not more than 0.7% by mass.

<24> The process for producing a cleaning liquid for a water-based ink according to any one of the above aspects <21> to <23>, wherein a mass ratio of the acetylene glycol (A) to the compound (B) [component (A)/component (B)] (i.e., a mass ratio of [(A)/(B)]) is preferably not less than 0.1, more preferably not less than 0.5 and even more preferably not less than 0.7, and is also preferably not more than 2, more preferably not more than 1.5 and even more preferably not more than 1.3.

EXAMPLES

In the following Examples, Comparative Examples and Production Examples, the "part(s)" and "%" indicate "part (s) by mass" and "% by mass", respectively, unless otherwise specified.

(1) Viscosity of Cleaning Liquid

The viscosity of the cleaning solution was measured at 25° C. using an E-type viscometer "TV-25" (equipped with a standard cone rotor 1° 34'×R24; rotating speed: 50 rpm) available from Toki Sangyo Co., Ltd.

(2) pH of Cleaning Liquid

The pH value of the cleaning liquid was measured at 25° C. using a bench-top pH meter "F-71" available from Horiba Ltd., equipped with a pH electrode "6337-10D" available from Horiba Ltd.

(3) Weight-Average Molecular Weight of Water-Insoluble Polymer

The molecular weight of the water-insoluble polymer was measured by gel permeation chromatography [GPA apparatus: "HLA-8120 GPA" available from Tosoh Corporation; columns: "TSK-GEL, α-M"×2 available from Tosoh Corporation; flow rate: 1 mL/min)] using a solution prepared by dissolving phosphoric acid and lithium bromide in N,N-dimethylformamide such that concentrations of phosphoric acid and lithium bromide in the resulting solution were 60 mmol/L and 50 mmol/L, respectively, as an eluent. Meanwhile, in the aforementioned measurement, monodisperse polystyrenes having known molecular weights were respectively used as a reference standard substance.

Example 1 (Production of Cleaning Liquid 1)

One gram (1.0 g) of "SURFYNOL 104PG-50" (tradename; a propylene glycol solution of 2,4,7,9-tetramethyl-5-decyne-4,7-diol; active ingredient content: 50%; average molar number of addition of EO: 0) as the component (A) available from Air Products & Chemicals, Inc., was mixed with 0.5 g of polyoxyethylene lauryl ether (average molar number of addition of EO: 12 mol) as the component (B), and 3.0 g of propylene glycol and 2.5 g of diethylene glycol monobutyl ether both serving as the component (C), followed by stirring the resulting mixture. Next, 0.2 g of a sodium hydroxide aqueous solution (0.1 N) and 0.02 g of an antiseptic agent "JCL-400" (tradename) available from JOHOKU CHEMICAL Co., Ltd., were added to the mixture, and then ion-exchanged water was added thereto to adjust a whole amount of the resulting mixed solution to 100 g.

The thus obtained mixed solution was passed through a 1.5 μm-mesh filter, thereby obtaining a cleaning liquid 1 (viscosity: 1.17 mPa·s; pH: 9.5).

Examples 2 to 7, Comparative Examples 1 to 6 and Reference Example 1

(Production of Cleaning Liquids 2 to 14)

The same procedure as in Example 1 was repeated except that the composition formulated was changed as shown in Table 3, thereby obtaining cleaning liquids 2 to 13 (viscosity: 1.05 to 2 mPa·s; pH: 9 to 9.6).

Meanwhile, in Reference Example 1 (cleaning liquid 14), a cleaning liquid for gravure ink "NT602" (tradename; organic solvent: ethyl acetate) commercially available from TOYO INK Co., Ltd., was used.

Incidentally, the details of the respective components shown in Table 3 are as follows.

"SURFYNOL 420" (tradename; EO adduct of 2,4,7,9-tetramethyl-5-decyne-4,7-diol; average molar number of addition of EO: 1.3 mol; active ingredient content: 100%) available from Air Products & Chemicals, Inc.

"SURFYNOL 485" (tradename; EO adduct of 2,4,7,9-tetramethyl-5-decyne-4,7-diol; average molar number of addition of EO: 30 mol; active ingredient content: 100%) available from Air Products & Chemicals, Inc.

"SURFYNOL 465" (tradename; EO adduct of 2,4,7,9-tetramethyl-5-decyne-4,7-diol; average molar number of addition of EO: 10 mol; active ingredient content: 100%) available from Air Products & Chemicals, Inc.

Production Example 1 (Production of Water-Based Ink)

(1) Production of Water-Insoluble Polymer Solution

The respective components shown in the column "Initially Charged Monomer Solution" in Table 1 were charged into a reaction vessel equipped with two dropping funnels 1 and 2 and mixed with each other, and an inside atmosphere of the reaction vessel was replaced with nitrogen gas, thereby obtaining an initially charged monomer solution.

Next, the respective components shown in each of the columns "Dropping Monomer Solution 1" and "Dropping Monomer Solution 2" in Table 1 were mixed with each other to obtain a dropping monomer solution 1 and a dropping monomer solution 2, respectively. The thus obtained dropping monomer solution 1 and dropping monomer solution 2 were charged into the dropping funnel 1 and the dropping funnel 2, respectively, and an inside atmosphere of each of the dropping funnel 1 and the dropping funnel 2 was replaced with nitrogen gas.

In a nitrogen atmosphere, the initially charged monomer solution in the reaction vessel was maintained at 77° C. while stirring, and the dropping monomer solution 1 in the dropping funnel 1 was gradually added dropwise to the reaction vessel over 3 hours. Next, the dropping monomer solution 2 in the dropping funnel 2 was gradually added dropwise to the reaction vessel over 2 hours. After completion of the dropwise addition, the mixed solution in the reaction vessel was stirred at 77° C. for 0.5 hour.

Then, a polymerization initiator solution prepared by dissolving 1.1 parts of a polymerization initiator "V-65" (tradename; 2,2'-azobis(2,4-dimethylvaleronitrile)) available from Wako Pure Chemical Industries, Ltd., in 47.3 parts of methyl ethyl ketone (hereinafter also referred to merely as "MEK") was added to the mixed solution, and the resulting reaction solution was aged at 77° C. for 0.5 hour while stirring. The aforementioned procedure including the preparation and addition of the polymerization initiator solution and the aging of the reaction solution was repeated twelve more times. Then, while maintaining the reaction solution in the reaction vessel at 80° C. for 1 hour, 8,456 parts of MEK were added thereto to adjust a solid content of the reaction solution to 36%, thereby obtaining a solution of a water-insoluble polymer (i-1). The weight-average molecular weight of the thus obtained water-insoluble polymer (i-1) was 67,000.

Meanwhile, the details of the respective components shown in Table 1 were as follows.

Styrene-based macromer: "AS-6 S" (active ingredient content: 50% by mass; number-average molecular weight: 6,000) available from Toagosei Co., Ltd.

NK ESTER M-40G: Methoxy polyethylene glycol monomethacrylate (average molecular weight of addition of ethyleneoxide: n=4) available from Shin-Nakamura Chemical Co., Ltd.

V-65: Polymerization initiator "V-65" (tradename; 2,2'-azobis(2,4-dimethylvaleronitrile)) available from Wako Pure Chemical Industries, Ltd.

2-Mercaptoethanol: Chain transfer agent

TABLE 1

| | Initially charged monomer solution (part(s)) | Dropping monomer solution 1 (part(s)) | Dropping monomer solution 2 (part(s)) |
|---|---|---|---|
| Ionic monomer | | | |
| Methacrylic acid | — | 1152 | 288 |
| Hydrophobic monomer | | | |
| Styrene | 396 | 3168 | 396 |
| Styrene-based macromer | 135 | 1215 | — |
| Hydrophilic nonionic monomer | | | |
| NK ESTER M-40G | 225 | 1800 | 225 |
| Methyl ethyl ketone | 157.5 | 1732.5 | 1260 |
| Toluene | 135 | 1215 | — |
| V-65 | — | 72 | 18 |
| 2-Mercaptoethanol | 1.3 | 8.82 | 2.52 |

(2) Production of Water Dispersion of Pigment-Containing Polymer Particles

The resulting water-insoluble polymer (i-1) solution (solid content: 36%) and MEK were mixed with each other in amounts of 178.7 parts and 45 parts, respectively, thereby obtaining an MEK solution of the water-insoluble polymer (i-1). The resulting MEK solution of the water-insoluble polymer (i-1) was charged into a 2 L-capacity disper, and while stirring the solution at 1,400 rpm, 511.4 parts of ion-exchanged water, 22.3 parts of a 5N sodium hydroxide aqueous solution and 1.7 parts of a 25% ammonia aqueous solution were added thereto such that the degree of neutralization of the water-insoluble polymer by sodium hydroxide was adjusted to 78.8 mol % and the degree of neutralization of the water-insoluble polymer by ammonia was adjusted to 21.2 mol %. The resulting reaction solution was stirred at 1,400 rpm for 15 minutes while cooling the solution in a water bath at 0° C.

Then, 150 parts of carbon black "MONARCH717" (tradename) as a black pigment available from Cabot Corporation were added to the reaction solution, and the resulting mixture was stirred at 6,400 rpm for 1 hour. The obtained pigment mixture was subjected to dispersion treatment under a pressure of 150 MPa by passing the mixture through a Microfluidizer "M-7115" available from Microfluidics Corporation 9 times, thereby obtaining a dispersion treatment product (solid content of 25%).

A 2 L eggplant-shaped flask was charged with 324.5 parts of the dispersion treatment product obtained in the above step, and then 216.3 parts of ion-exchanged water were added thereto (solid content: 15%). The resulting mixture was maintained under a pressure of 0.09 MPa in a warm water bath adjusted at 32° C. for 3 hours using a rotary distillation apparatus "Rotary Evaporator N-1000 S" available from Tokyo Rikakikai Co., Ltd., operated at a rotating speed of 50 r/min to remove the organic solvent therefrom. Further, the temperature of the warm water bath was adjusted to 62° C., and the pressure therein was reduced to 0.07 MPa, and the reaction solution was concentrated under this condition until reaching a solid content of 25%.

The thus obtained concentrated solution was charged into a 500 mL angle rotor, and subjected to centrifugal separation using a high-speed cooling centrifuge "himac CR22G" (temperature set: 20° C.) available from Hitachi Koki Co., Ltd., at 7,000 rpm for 20 minutes. Thereafter, the resulting liquid layer portion which was separated by the centrifugal separation was filtered by filtration treatment through a 1.2 μm-mesh filter "MAP-010XS" available from ROKI TECHNO Co., Ltd., thereby recovering a filtrate containing pigment-containing polymer particles (I-1) (black).

Three hundred parts of the resulting filtrate (pigment: 52.5 parts; water-insoluble polymer (i-1): 22.5 parts) were mixed with 0.68 part of "Ploxel LVS" (mildew-proof agent; active ingredient content: 20%; water content: 80%) available from Arch Chemicals Japan, Inc., and further mixed with 40.23 parts of ion-exchanged water so as to adjust a solid content of the resulting mixture to 22%, followed by stirring the mixture for 1 hour at room temperature, thereby obtaining a water dispersion of the pigment-containing polymer particles (I-1) (black).

(3) Production of Water Dispersion of Pigment-Free Water-Insoluble Polymer Particles The respective components shown in the column "Initially Charged Monomer Emulsion" in Table 2 were charged into a reaction vessel equipped with a dropping funnel, and mixed with each other, and an inside atmosphere of the reaction vessel was replaced with nitrogen gas, thereby obtaining an initially charged monomer emulsion. In addition, the respective components shown in the column "Dropping Monomer Emulsion" in Table 2 were mixed with each other to obtain a dropping monomer emulsion. The resulting dropping monomer emulsion was charged into the dropping funnel, and an inside atmosphere of the dropping funnel was replaced with nitrogen gas.

In a nitrogen atmosphere, the initially charged monomer emulsion in the reaction vessel was heated from room temperature to 80° C. over 30 minutes while stirring, and then while maintaining the initially charged monomer emulsion in the reaction vessel at 80° C., the dropping monomer emulsion in the dropping funnel was gradually added dropwise to the reaction vessel over 3 hours. After completion of the dropwise addition, the mixed solution in the reaction vessel was stirred for 1 hour while maintaining an inside temperature of the reaction vessel at 80° C. Next, the resulting reaction mixture was filtered through a 200-mesh filter to recover a filtrate containing pigment-free water-insoluble polymer particles (II-1), thereby obtaining a water dispersion of the pigment-free water-insoluble polymer particles (II-1) (solid content: 40%). The weight-average molecular weight of the thus obtained pigment-free water-insoluble polymer particles (II-1) was 550,000.

Meanwhile, the details of the respective components shown in Table 2 are as follows.

LATEMUL E-118B: Sodium polyoxyethylenealkylethersulfate as a surfactant available from Kao Corporation Potassium persulfate: Polymerization initiator available from Wako Pure Chemical Industries, Ltd.

TABLE 2

| | Initially charged monomer emulsion (part(s)) | Dropping monomer emulsion (part(s)) |
|---|---|---|
| Ionic monomer | | |
| Methacrylic acid | 0.5 | 9.5 |
| Hydrophobic monomer | | |
| Methyl methacrylate | 14.5 | 275.5 |
| 2-Ethylhexyl acrylate | 5.0 | 95.0 |
| LATEMUL E-118B | 11.1 | 35.1 |
| Ion-exchanged water | 382.8 | 183.0 |
| Potassium persulfate | 0.2 | 0.6 |

(4) Production of Water-Based Ink

The water dispersion of the pigment-containing polymer particles (I-1) (solid content: 22%) and the water dispersion of the pigment-free water-insoluble polymer particles (II-1) (solid content: 40%) were used to produce a water-based ink 1. More specifically, ion-exchanged water was added to the mixed water dispersion such that the contents of the pigment and the pigment-free water-insoluble polymer particles (II-1) in the resulting ink were 5% and 2%, respectively, and then a 1N sodium hydroxide aqueous solution was added to the dispersion such that the pH value of the resulting solution fell within the range of 8.5 to 10.0, and the respective components were compounded with each other at the following compositional ratio, thereby obtaining a mixed solution. The thus obtained mixed solution was filtered through the aforementioned 1.5 μm-mesh filter, thereby obtaining the water-based ink 1.

Meanwhile, the content of the polymer component in the water-based ink 1 was a total content of the water-insoluble polymer (i-1) and the pigment-free polymer particles (II-1), i.e., 4.15%, and the content of water in the water-based ink 1 was the balance assuming that the whole amount of the ink was 100%.

<Composition>

| | |
|---|---|
| Water dispersion of pigment-containing polymer particles (I-1) (having a solid content of 22% and containing 5 parts of the black pigment and 2.15 parts of the water-insoluble polymer (i-1)) | 32.5 parts |
| Water dispersion of pigment-free polymer particles (II-1) (solid content: 40%) | 5.0 parts |
| Nonionic surfactant (tripropylene glycol monooctyl ether; average molar number of addition of propyleneoxide: 3 mol) available from Kao Corporation | 1.5 parts |
| Propylene glycol | 20.0 parts |
| "SURFYNOL 104PG-50" (a propylene glycol solution of an acetylene glycol-based nonionic surfactant; active ingredient content: 50%) available from Nissin Chemical Co., Ltd. | 2.0 parts |
| "EMULGEN 120" (polyoxyethylene lauryl ether) available from Kao Corporation | 2.0 parts |
| 1N sodium hydroxide aqueous solution | 0.5 part |

Meanwhile, the amount of water compounded was an amount of water contained in the ink whose whole amount was adjusted to 100 parts.

The cleaning liquids 1 to 14 obtained above were evaluated by the following methods. The results are shown in Table 3.

<Evaluation of Cleanability for Ink>

Ten microliters (10 μL) of the ink (water-based ink 1) obtained in Production Example 1 were charged in a petri dish, and dried at 40° C. for 3 hours. Then, 5 g of the cleaning liquid was added to the petri dish, and then shaken for 1 minute, if necessary followed by subjecting the contents of the petri dish to decantation, to remove the cleaning liquid therefrom. The extent of presence of the residual ink was visually observed and evaluated by the six ranks of from 0 to 5 according to the following evaluation ratings. The Rank 4 or 5 of the evaluation ratings indicates that the cleaning liquid had sufficient cleanability for ink and could be used in practical applications.

(Evaluation Ratings)

5: No ink remained.

4: Peripheral edge portion of the dried ink droplet partially remained.

3: Peripheral edge portion of the dried ink droplet remained.

2: Shape of the dried ink was recognized, and about a half amount of the ink remained.

1: Shape of the dried ink was recognized, and a half amount or more of the ink remained.

0: Substantially the whole amount of the dried ink remained unremoved.

<Evaluation of Dissolvability of Surfactant in Cleaning Liquid>

The cleaning liquid was charged into a beaker and stirred, and then allowed to stand therein for 24 hours. Thereafter, the appearance of the cleaning liquid was visually observed and evaluated by the four ranks according to the following evaluation ratings. The Rank 2 or 3 of the evaluation ratings indicates that the cleaning liquid had sufficient dissolvability of a surfactant therein and could be used in practical applications.

3: Kept in a transparent state from immediately after being prepared.

2: White turbidity occurred immediately after being prepared, but rendered transparent by stirring.

1: White turbidity occurred even after stirring.

0: Separated immediately even after stirring.

<Evaluation of Residual Cleaning Liquid>

A surface of a print head and a surface of a gravure printing plate cylinder both serving as a member to be cleaned were wiped with a nonwoven fabric "ASPURE WIPER" available from AS ONE Corporation which had been previously impregnated and moistened with the cleaning liquid. Thereafter, the extent of presence of the residual cleaning liquid on the surface of the respective members to be cleaned after wiping was visually observed and evaluated by the six ranks of from 0 to 5 according to the following evaluation ratings. The Rank 4 or 5 of the evaluation ratings indicates that the cleaning liquid could be used in practical applications.

5: No cleaning liquid remained.

4: A slight amount of the cleaning liquid remained to such an extent that the residual cleaning liquid was not noticeable.

3: Residual cleaning liquid was interspersed on the surface of the respective members to be cleaned.

2: Cleaning liquid remained on 40% or more of an entire surface of the print head or the gravure printing plate cylinder.

1: Cleaning liquid remained on 70% or more of an entire surface of the print head or the gravure printing plate cylinder.

0: Cleaning liquid remained over an entire surface of each of the print head and the gravure printing plate cylinder.

TABLE 3

| | Examples | | | | | | | Comparative Examples | | | | | | Ref. |
|---|---|---|---|---|---|---|---|---|---|---|---|---|---|---|
| | 1 | 2 | 3 | 4 | 5 | 6 | 7 | 1 | 2 | 3 | 4 | 5 | 6 | Ex. 1 |
| Cleaning solution No. | 1 | 2 | 3 | 4 | 5 | 6 | 7 | 8 | 9 | 10 | 11 | 12 | 13 | 14 |
| Composition of cleaning liquid formulated (g) | | | | | | | | | | | | | | NT-602*1 |
| Acetylene glycol (A) | | | | | | | | | | | | | | |
| SURFYNOL 104PG-50 (average molar number of addition of EO: 0) | 1.0 | 1.0 | | | 1.0 | 1.0 | 1.0 | | | 2.0 | 1.0 | 1.0 | 1.0 | |
| SURFYNOL 420 (average molar number of addition of EO: 1.3) | | | 0.5 | 0.5 | | | | | | | | | | |
| Compound (B) | | | | | | | | | | | | | | |
| SURFYNOL 485 (average molar number of addition of EO: 30) | | | | | | | 0.5 | | | | | | | |
| SURFYNOL 465 (average molar number of addition of EO: 10) | | 0.5 | | 0.5 | | | | | 1.0 | | | | | |

TABLE 3-continued

| | Examples | | | | | | | Comparative Examples | | | | | | Ref. |
|---|---|---|---|---|---|---|---|---|---|---|---|---|---|---|
| | 1 | 2 | 3 | 4 | 5 | 6 | 7 | 1 | 2 | 3 | 4 | 5 | 6 | Ex. 1 |
| Polyoxy-ethylene lauryl ether (average molar number of addition of EO: 12) | 0.5 | | 0.5 | | 0.5 | 0.5 | | 1.0 | | | 0.5 | 0.5 | 0.5 | |
| Water-soluble organic solvent (C) | | | | | | | | | | | | | | |
| Propylene glycol | 3.0 | 3.0 | 3.0 | 3.0 | 10.5 | | 3.0 | 3.0 | 3.0 | 3.0 | | 13.0 | 16.0 | |
| Diethylene glycol | | | | | | 3.0 | | | | | | | | |
| Diethylene glycol monobutyl ether | 2.5 | 2.5 | 2.5 | 2.5 | 8.5 | 2.5 | 2.5 | 2.5 | 2.5 | 2.5 | 2.5 | 11.0 | 14.0 | |
| Glycerin | | | | | | | | | | | 3.0 | | | |
| Other components | | | | | | | | | | | | | | |
| Sodium hydroxide (0.1N) | 0.2 | 0.2 | 0.2 | 0.2 | 0.2 | 0.2 | 0.2 | 0.2 | 0.2 | 0.2 | 0.2 | 0.2 | 0.2 | |
| Antiseptic agent (JCL-400) | 0.02 | 0.02 | 0.02 | 0.02 | 0.02 | 0.02 | 0.02 | 0.02 | 0.02 | 0.02 | 0.02 | 0.02 | 0.02 | |
| Water | | | | | | | | | | | | | | |
| Ion-exchanged water*3 | bal.* | bal.* | bal.* | bal.* | bal.* | bal.* | bal.* | bal.* | bal.* | bal.* | bal.* | bal.* | bal.* | |
| Content (%) of water-soluble organic solvent (C)*4 | 6.0 | 6.0 | 5.5 | 5.5 | 19.5 | 6.0 | 6.0 | 5.5 | 5.5 | 6.5 | 6.0 | 24.5 | 30.5 | — |
| Boiling point (° C.) of water-soluble organic solvent (C) | | | | | | | | | | | | | | |
| Weighted mean value*5 | 207.2 | 207.2 | 207.2 | 207.2 | 206.9 | 237.8 | 207.2 | 207.2 | 207.2 | 207.2 | 262.7 | 207.4 | 207.7 | 77 |
| Weighted mean value*6 | 205.6 | 205.6 | 207.2 | 207.2 | 206.4 | 233.7 | 205.6 | 207.2 | 207.2 | 204.3 | 256.5 | 207.0 | 207.4 | |
| Evaluation | | | | | | | | | | | | | | |
| Cleanability for ink | 5 | 5 | 5 | 5 | 4 | 5 | 5 | 2 | 2 | *2 | 2 | 3 | 1 | 2 |
| Dissolvability of surfactant in cleaning liquid | 3 | 3 | 3 | 3 | 2 | 3 | 3 | 3 | 3 | 0 | 1 | 3 | 3 | — |

TABLE 3-continued

| | Examples | | | | | | | Comparative Examples | | | | | | Ref. |
|---|---|---|---|---|---|---|---|---|---|---|---|---|---|---|
| | 1 | 2 | 3 | 4 | 5 | 6 | 7 | 1 | 2 | 3 | 4 | 5 | 6 | Ex. 1 |
| Residual cleaning liquid | | | | | | | | | | | | | | |
| Print head | 5 | 4 | 4 | 4 | 4 | 4 | 4 | 5 | 5 | *2 | 1 | 2 | 1 | 5 |
| Gravure printing plate cylinder | 5 | 5 | 5 | 5 | 4 | 4 | 5 | 5 | 5 | *2 | 1 | 2 | 1 | 5 |

Note bal.*: Balance

The respective asterisked notations shown in Table 3 are as follows.

*[1]Cleaning liquid for gravure ink "NT602" (organic solvent: ethyl acetate) available from TOYO INK Co., Ltd.

*2: Having no function as a cleaning liquid since the surfactant was separated therefrom.

*[3]The amount of ion-exchanged water compounded was the balance assuming that the whole amount of the cleaning liquid was 100 g.

*[4]Content of the water-soluble organic solvent (C) in the cleaning liquid; in the case of using "SURFYNOL 104PG-50" (active ingredient content: 50%) as the acetylene glycol (A), the aforementioned content of the water-soluble organic solvent (C) was a sum of the amount of the water-soluble organic solvent (C) compounded and the amount of propylene glycol derived from "SURFYNOL 104PG-50".

*[5]Weighted mean value of the boiling point of the water-soluble organic solvent (C) as calculated by excluding the amount of propylene glycol derived from "SURFYNOL 104PG-50".

*[6]Weighted mean value of the boiling point of the water-soluble organic solvent (C) as calculated by taking into consideration, i.e., including the amount of propylene glycol derived from "SURFYNOL 104PG-50".

From Table 3, it was confirmed that the cleaning liquids obtained in Examples 1 to 7 were excellent in cleanability for ink and dissolvability of a surfactant therein and hardly remained on the member to be cleaned, as compared to the cleaning liquids obtained in Comparative Examples 1 to 6.

The cleaning liquids obtained in Comparative Examples 1 and 2 in which no acetylene glycol (A) was used were deteriorated in cleanability for ink as compared to the cleaning liquids obtained in Examples 1 to 7.

The cleaning liquid obtained in Comparative Example 3 in which no compound (B) was used was deteriorated in dissolvability of a surfactant therein as compared to the cleaning liquids obtained in Examples 1 to 7.

The cleaning liquid obtained in Comparative Example 4 in which the boiling point of the water-soluble organic solvent (C) was not lower than 250° C. was deteriorated in cleanability for ink and dissolvability of a surfactant therein, and remained on the member to be cleaned, as compared to the cleaning liquids obtained in Examples 1 to 7.

The cleaning liquids obtained in Comparative Examples 5 and 6 in which the content of the water-soluble organic solvent (C) therein exceeded 20% by mass were deteriorated in cleanability for ink, and remained on the member to be cleaned, as compared to the cleaning liquids obtained in Examples 1 to 7.

In Reference Example 1 in which the commercially available cleaning liquid for gravure printing containing ethyl acetate as a solvent was used, although the extent of presence of the cleaning liquid remaining on the member to be cleaned was similar to that of the respective cleaning liquids obtained in Examples 1 to 7, the cleaning liquid used in Reference Example 1 was deteriorated in cleanability for ink, as compared to the cleaning liquids obtained in Examples 1 to 7.

INDUSTRIAL APPLICABILITY

The cleaning liquid of the present invention is excellent in cleanability for ink and dissolvability of a surfactant therein, and hardly remains on a member to be cleaned, and therefore can be suitably used as a cleaning liquid for a water-based ink that contains a pigment and a water-insoluble polymer.

The invention claimed is:

1. A cleaning liquid for a water-based ink that comprises a pigment and a water-insoluble polymer, said cleaning liquid comprising (A) an acetylene glycol having an average molar number of addition of ethyleneoxide of not less than 0 mol and not more than 2 mol, (B) at least one compound selected from the group consisting of (b-1) an acetylene glycol having an average molar number of addition of ethyleneoxide of not less than 4 mol and (b-2) a polyethylene glycol alkyl ether comprising an alkyl group having not less than 8 carbon atoms, (C) a water-soluble organic solvent and water, in which the water-soluble organic solvent (C) comprises at least one water-soluble organic solvent having a boiling point of not lower than 90° C.;

a boiling point of the water-soluble organic solvent (C) is not higher than 250° C. in terms of a weighted mean value of boiling points of respective water-soluble organic solvents therein which are weighted by contents (% by mass) of the respective water-soluble organic solvents;

a content of the water-soluble organic solvent (C) in the cleaning liquid is not more than 20% by mass;

the water-soluble organic solvent (C) is a combination of a polyhydric alcohol and a polyhydric alcohol alkyl ether other than the polyethylene glycol alkyl ether (b-2); and the cleaning liquid comprises neither a pigment nor a polymer.

2. The cleaning liquid according to claim 1, wherein a mass ratio of the acetylene glycol (A) to the compound (B) [(A)/(B)] is not less than 0.1 and not more than 2.

3. The cleaning liquid according to claim 1, wherein a total content of the acetylene glycol (A) and the compound (B) in the cleaning liquid is not less than 0.5% by mass and not more than 5% by mass.

4. The cleaning liquid according to claim 1, wherein the average molar number of addition of ethyleneoxide of the acetylene glycol (b-1) is not more than 35 mol.

5. The cleaning liquid according to claim 1, wherein the polyethylene glycol alkyl ether (b-2) is represented by the following formula (1):

$$R^1O\text{-}(EO)_n\text{—}H \quad (1)$$

wherein $R^1$ is an alkyl group having not less than 8 carbon atoms; EO is an ethyleneoxide group; and n is an average molar number of addition of the ethyleneoxide group.

6. The cleaning liquid according to claim 5, wherein the average molar number n of addition of the ethyleneoxide group in the formula (1) is not less than 4 and not more than 30.

7. The cleaning liquid according to claim 5, wherein the number of carbon atoms of $R^1$ as the alkyl group in the formula (1) is not more than 18.

8. The cleaning liquid according to claim 1, wherein the content of the water-soluble organic solvent (C) in the cleaning liquid is not less than 1% by mass.

9. The cleaning liquid according to claim 1, wherein a content of the acetylene glycol (A) in the cleaning liquid is not less than 0.01% by mass and not more than 5% by mass.

10. The cleaning liquid according to claim 1, wherein a content of the compound (B) in the cleaning liquid is not less than 0.01% by mass and not more than 5% by mass.

11. A method of cleaning a water-based ink comprising the step of allowing a water-based ink that comprises a pigment and a water-insoluble polymer to come into contact with a cleaning liquid comprising (A) an acetylene glycol having an average molar number of addition of ethyleneoxide of not less than 0 mol and not more than 2 mol, (B) at least one compound selected from the group consisting of (b-1) an acetylene glycol having an average molar number of addition of ethyleneoxide of not less than 4 mol and (b-2) a polyethylene glycol alkyl ether comprising an alkyl group having not less than 8 carbon atoms, (C) a water-soluble organic solvent and water, in which the water-soluble organic solvent (C) comprises at least one water-soluble organic solvent having a boiling point of not lower than 90° C.;

a boiling point of the water-soluble organic solvent (C) is not higher than 250° C. in terms of a weighted mean value of boiling points of respective water-soluble organic solvents therein which are weighted by contents (% by mass) of the respective water-soluble organic solvents; and a content of the water-soluble organic solvent (C) in the cleaning liquid is not more than 20% by mass.

12. The method of cleaning a water-based ink according to claim 11, wherein the water-based ink is used for gravure printing or ink-jet printing.

13. A process for producing a cleaning liquid for a water-based ink, comprising the step of compounding (A) an acetylene glycol having an average molar number of addition of ethyleneoxide of not less than 0 mol and not more than 2 mol, (B) at least one compound selected from the group consisting of (b-1) an acetylene glycol having an average molar number of addition of ethyleneoxide of not less than 4 mol and (b-2) a polyethylene glycol alkyl ether comprising an alkyl group having not less than 8 carbon atoms, (C) a water-soluble organic solvent and water, in which the water-soluble organic solvent (C) comprises at least one water-soluble organic solvent having a boiling point of not lower than 90° C.;

a boiling point of the water-soluble organic solvent (C) is not higher than 250° C. in terms of a weighted mean value of boiling points of respective water-soluble organic solvents therein which are weighted by contents (% by mass) of the respective water-soluble organic solvents;

a content of the water-soluble organic solvent (C) in the cleaning liquid is not more than 20% by mass;

the water-soluble organic solvent (C) is a combination of a polyhydric alcohol and a polyhydric alcohol alkyl ether other than the polyethylene glycol alkyl ether (b-2); and the cleaning liquid comprises neither a pigment nor a polymer.

14. The cleaning liquid according to claim 1, wherein the acetylene glycol (A) is at least one compound selected from the group consisting of 2,4,7,9-tetramethyl-5-decyne-4,7-diol, 3,6-dimethyl-4-octyne-3,6-diol, 2,5-dimethyl-3-hexyne-2,5-diol, 2,5,8,11-tetramethyl-6-dodecyne-5,8-diol, 3,5-dimethyl-1-hexyne-3-ol and EO adducts of these compounds.

15. The cleaning liquid according to claim 1, wherein the acetylene glycol (b-1) is at least one compound selected from the group consisting of an EO adduct of 2,4,7,9-tetramethyl-5-decyne-4,7-diol, an EO adduct of 3,6-dimethyl-4-octyne-3,6-diol, an EO adduct of 2,5-dimethyl-3-hexyne-2,5-diol, an EO adduct of 2,5,8,11-tetramethyl-6-dodecyne-5,8-diol and an EO adduct of 3,5-dimethyl-1-hexyne-3-ol.

16. The cleaning liquid according to claim 5, wherein the polyethylene glycol alkyl ether (b-2) represented by the aforementioned formula (1) is at least one compound selected from the group consisting of polyethylene glycol mono-2-ethylhexyl ether, polyethylene glycol monooctyl ether, polyethylene glycol monodecyl ether, polyethylene glycol monododecyl ether and polyethylene glycol monotetradecyl ether.

17. The cleaning liquid according to claim 1, wherein a mass ratio of the polyhydric alcohol to the polyhydric alcohol alkyl ether other than the polyethylene glycol alkyl ether (b-2) [polyhydric alcohol/polyhydric alcohol alkyl ether other than polyethylene glycol alkyl ether (b-2)] is not less than 0.8 and not more than 2.

18. The cleaning liquid according to claim 1, wherein the boiling point of the water-soluble organic solvent (C) is not higher than 220° C. in terms of a weighted mean value of boiling points of respective water-soluble organic solvents therein which are weighted by contents (% by mass) of the respective water-soluble organic solvents.

19. The method of cleaning a water-based ink according to claim 11, wherein the water-soluble organic solvent (C) is a combination of a polyhydric alcohol and a polyhydric alcohol alkyl ether other than the polyethylene glycol alkyl ether (b-2).

20. The method of cleaning a water-based ink according to claim 11, wherein the water-soluble organic solvent (C) is a combination of a polyhydric alcohol and a polyhydric alcohol alkyl ether other than the polyethylene glycol alkyl ether (b-2), and a mass ratio of the polyhydric alcohol to the polyhydric alcohol alkyl ether other than the polyethylene glycol alkyl ether (b-2) [polyhydric alcohol/polyhydric alcohol alkyl ether other than polyethylene glycol alkyl ether (b-2)] is not less than 0.8 and not more than 2.

* * * * *